US007183250B2

(12) United States Patent
Rodrigues et al.

(10) Patent No.: US 7,183,250 B2
(45) Date of Patent: Feb. 27, 2007

(54) SURFACTANT COMPOSITION CONTAINING HYDROPHOBICALLY MODIFIED POLYMER

(75) Inventors: Klein A. Rodrigues, Signal Mountain, TN (US); Kevin Beairsto, Cincinnati, OH (US)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 25 days.

(21) Appl. No.: 10/464,365

(22) Filed: Jun. 17, 2003

(65) Prior Publication Data

US 2004/0259758 A1 Dec. 23, 2004

(51) Int. Cl.

| | |
|---|---|
| ***C11D 1/00*** | (2006.01) |
| ***C11D 1/02*** | (2006.01) |
| ***C11D 1/66*** | (2006.01) |
| ***C11D 1/83*** | (2006.01) |
| ***C11D 3/37*** | (2006.01) |

(52) U.S. Cl. ..... 510/535; 510/351; 510/356; 510/357; 510/360; 510/361; 510/421; 510/426; 510/434; 510/475

(58) Field of Classification Search ..... 510/351, 510/356, 357, 360, 361, 421, 426, 434, 475, 510/535

See application file for complete search history.

(56) References Cited

U.S. PATENT DOCUMENTS

| | | | | |
|---|---|---|---|---|
| 5,650,473 | A | 7/1997 | Kimpton et al. | 526/318.6 |
| 5,719,117 | A * | 2/1998 | Falk et al. | 510/475 |
| 5,723,434 | A * | 3/1998 | Falk et al. | 510/475 |
| 5,789,511 | A | 8/1998 | Kimpton et al. | 526/318.6 |
| 5,886,076 | A | 3/1999 | Kimpton et al. | 524/339 |
| 5,998,355 | A * | 12/1999 | Brumbaugh | 510/424 |
| 6,337,313 | B1 | 1/2002 | Rodrigues | 510/476 |
| 6,136,774 | A1 | 10/2002 | Mertens | |
| 2004/0259758 | A1 * | 12/2004 | Rodrigues et al. | 510/475 |
| 2005/0119146 | A1 | 6/2005 | Rodrigues | |

FOREIGN PATENT DOCUMENTS

| | | |
|---|---|---|
| EP | 0636687 A | 2/1995 |

OTHER PUBLICATIONS

U.S. Appl. No. 10/047,957.

* cited by examiner

*Primary Examiner*—Brian Mruk
(74) *Attorney, Agent, or Firm*—David LeCroy

(57) ABSTRACT

The present invention is related to a concentrated surfactant composition containing a hydrophobically modified polymer and/or a hydrotrope. The addition of the polymer or hydrotrope to the concentrated surfactant changes the physical properties of the concentrated surfactant, making it easier to process.

13 Claims, No Drawings

SURFACTANT COMPOSITION CONTAINING HYDROPHOBICALLY MODIFIED POLYMER

The present invention relates to a concentrated surfactant composition containing hydrophobically modified polymer and/or other amphiphilic compounds such as hydrotropes. In particular the addition of hydrophobically modified polymer or hydrotrope to the surfactant concentrate results in improved processing of the surfactant, decreasing both time and expense in manufacturing.

BACKGROUND OF THE INVENTION

Cleaning compositions, such as detergents, shampoos, and cleaners include one or more surfactants or soaps to allow for the removal of organic material form a substrate in an aqueous environment. The surfactants are sold as concentrates that must generally be melted for processing into final commercial products.

The cleaning compositions also contain other ingredients, such as hydrophobically modified polymers, and amphiphilic compounds such as hydrotropes, which provide beneficial product and end-use properties.

Hydrotropes are added to isotropic liquid detergents to help incorporate higher levels of surfactants and to help prevent phase separation of the detergent. The use of hydrotropes in isotropic liquid detergents is described in U.S. Pat. No. 5,719,117.

Hydrophobically modified water-soluble polymers are used in laundry and cleaning compositions, and are useful for soil release properties and in preventing soil redeposition. U.S. Pat. No. 5,723,434 describes the use of a hydrophilic polymer backbone having a hydrophobic pendant group in isotropic liquid detergents. The polymer helps improve the clarity of the isotropic liquid detergent. U.S. Patent Publication No. 2003/0162679 describes hydrophobically modified polymers as being useful in increasing the dissolution rates of surfactants into aqueous systems, especially from single-dose tablets, pouches, and sachets. Furthermore, these polymers are useful in suspending hydrophobic soils in autodish and hard surface cleaning applications. The hydrophobically modified polymers also act as corrosion inhibitors for aluminum in a variety of applications.

U.S. Pat. No. 5,789,511 describes the synthesis of styrene or substituted styrene monomer with a carboxylated monomer to produce a hydrophobically modified water-soluble polymer. These polymers provide good soil release properties and are useful in cleaning compositions for fabrics and hard surfaces.

U.S. Pat. No. 6,337,313 describes the synthesis and use of hydrophobically modified polymers with hydrophilic backbones and at least one hydrophobic moiety in a textile manufacturing or treating process.

U.S. Pat. No. 5,886,076 describes a cleaning composition having an alcohol ethoxylate surfactant and 1 to 10 percent of a polymer of styrene and a carboxylate monomer. The polymer provides good soil release properties.

The cited references describe the combination of hydrophobically modified water-soluble polymers or hydrotropes with surfactants in the context of laundry and other cleaning compositions. These ingredients play key roles in the effectiveness of the detergent of cleaning composition. None of the references describe any synergy to a concentrated blend of a hydrophobically modified polymer or hydrotrope with a surfactant.

Surprisingly it has now been found that hydrophobically modified water-soluble polymers and hydrotropes effectively change the physical properties of concentrated surfactants, making the surfactants easier and faster to process into useful end-products. The modified concentrated surfactant composition shows an increase in the rate of surfactant dissolution, and a lower melting point of the surfactant, improving the ease of handling.

SUMMARY OF THE INVENTION

It is an objective of the present invention to form a concentrated surfactant composition containing one or more surfactants and one or more hydrophobically modified polymers and/or hydrotropes.

It is an objective of the present invention to improve the processing properties of concentrated surfactants by combining them with hydrophobically modified polymers and/or hydrotropes.

The present invention is directed to a concentrated surfactant composition comprising:

a) at least 50 percent by weight of a modified surfactant blend comprising:
   1) one or more surfactants; and
   2) from 0.1 to 10 percent by weight of a hydrophobically modified copolymer, a hydrotrope, or a mixture thereof, based on the weight of the surfactant; and b) from 0 to 49.9 percent by weight of water.

DETAILED DESCRIPTION OF THE INVENTION

The present invention is directed to a concentrated surfactant composition containing one or more surfactants and one or more hydrophobically modified polymers and/or hydrotropes.

The hydrophobically modified polymer has a hydrophilic backbone and at least one hydrophobic moiety. The polymer may have a random, block, star, or other known architecture. The hydrophilic backbone may be linear or branched and is prepared from at least one ethylenically unsaturated hydrophilic monomer selected from unsaturated acids preferably $C_1$–$C_6$ acids, amides, ethers, alcohols, aldehydes, anhydrides, ketones and esters; polymerizable hydrophilic cyclic monomers; and non-ethylenically unsaturated polymerizable hydrophilic monomers selected from glycerol and other polyhydric alcohols. Combinations of hydrophilic monomers may also be used. Preferably the hydrophilic monomers are sufficiently water soluble to form at least a 1% by weight solution in water.

Preferably the ethylenically unsaturated hydrophilic monomers are mono-unsaturated. Examples of ethylenically unsaturated hydrophilic monomers are, for example, acrylic acid, methacrylic acid, ethacrylic acid, alpha-chloro-acrylic acid, alpha-cyano acrylic acid, beta methyl-acrylic acid (crotonic acid), alpha-phenyl acrylic acid, beta-acryloxy propionic acid, sorbic acid, alpha-chloro sorbic acid, angelic acid, cinnamic acid, p-chloro cinnamic acid, beta-styryl acrylic acid (1-carboxy-4-phenyl butadiene-1,3), itaconic acid, maleic acid, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, vinyl phosphonic acid, 2-hydroxy ethyl acrylate, tri methyl propane triacrylate, sodium methallyl sulfonate, sulfonated styrene, allyloxybenzenesulfonic acid, dimethylacrylamide, dimethylaminopropylmethacrylate, diethylaminopropylmethacrylate, vinyl formamide, vinyl acetamide, polyethylene glycol esters of acrylic acid and methacrylic acid and itaconic acid, vinyl pyrrolidone, vinyl imidazole, maleic acid, and maleic anhydride. Combinations of ethylenically unsaturated hydrophilic monomers may also be used. Preferably, the ethylenically unsaturated hydrophilic monomer is selected from acrylic acid, methacrylic acid, maleic acid, and itaconic acid.

The polymerizable hydrophilic cyclic monomers may have cyclic units that are either unsaturated or contain groups capable of forming inter-monomer linkages. In linking such cyclic monomers, the ring-structure of the monomers may either be kept intact, or the ring structure may be disrupted to form the backbone structure. Examples of cyclic units are sugar units such as saccharides and glucosides, cellulose ethers, and alkoxy units such as ethylene oxide and propylene oxide.

The hydrophilic backbone of the hydrophobically modified polymer may optionally be substituted with one or more amino, amine, amide, sulfonate, sulfate, phosphonate, hydroxy, carboxyl or oxide groups. The hydrophilic backbone of the polymer may also contain small amounts of relatively hydrophobic units, for example, units derived from polymers having a solubility of less than 1 g/l in water, provided that the overall solubility of the polymer in water at ambient temperature and at a pH of 3.0 to 12.5 is more than 1 g/l, more preferably more than 5 g/l, and most preferably more than 10 g/l. Examples of relatively water insoluble monomers are vinyl acetate, methyl methacrylate, ethyl acrylate, ethylene, propylene, hydroxy propyl acetate, styrene, octyl methacrylate, lauryl methacrylate, stearyl methacrylate, behenyl methacrylate.

The hydrophobic moieties are linked to the hydrophilic backbone by any possible chemical link, although the following types of linkages are preferred:

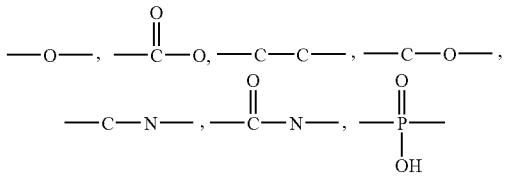

Preferably the hydrophobic moieties are part of a monomer unit which is incorporated in the polymer by copolymerising hydrophobic monomers and the hydrophilic monomers making up the backbone of the polymer. The hydrophobic moieties preferably include those which when isolated from their linkage are relatively water insoluble, i.e. preferably less than 1 g/l more preferred less than 0.5 g/l, most preferred less than 0.1 g/l of the hydrophobic monomers, will dissolve in water at ambient temperature and a pH of 3 to 12.5.

Preferably the hydrophobic moieties are selected from siloxanes, aryl sulfonate, saturated and unsaturated alkyl moieties optionally having sulfonate end groups, wherein the alkyl moieties have from 5 to 24 carbon atoms, preferably from 6 to 18, most preferred from 8 to 16 carbon atoms, and are optionally bonded to the hydrophilic backbone by means of an alkoxylene or polyalkoxylene linkage, for example a polyethoxy, polypropoxy or butyloxy (or mixtures of same) linkage having from 1 to 50 alkoxylene groups. Alternatively the hydrophobic moiety may be composed of relatively hydrophobic alkoxy groups, for example butylene oxide and/or propylene oxide, in the absence of alkyl or alkenyl groups.

Examples of hydrophobic monomers include styrene, α-methyl styrene, 2-ethylhexyl acrylate, octylacrylate, lauryl acrylate, stearyl acrylate, behenyl acrylate, 2-ethylhexyl methacrylate, octylmethacrylate, lauryl methacrylate, stearyl methacrylate, behenyl methacrylate, 2-ethylhexyl acrylamide, octylacrylamide, lauryl acrylamide, stearyl acrylamide, behenyl acrylamide, propyl acrylate, butyl acrylate, pentyl acrylate, hexyl acrylate, 1-vinyl naphthalene, 2-vinyl naphthalene, 3-methyl styrene, 4-propyl styrene, t-butyl styrene, 4-cyclohexyl styrene, 4-dodecyl styrene, 2-ethyl-4-benzyl styrene, 4-(phenylbutyl) styrene, isobutylene, and vinyl methyl ether. The hydrotrophobic monomer could also be an associative monomer, such as an alcohol ethoxylate. Combinations of hydrophobic monomers may also be used.

Alternatively, the hydrophobic moiety may be introduced into the polymer in the form of a chain transfer agent. The chain transfer agent has from 1 to 24 carbon atoms, preferably 1 to 14 carbon atoms, more preferably 3 to 12 carbon atoms. The chain transfer agent is selected from mercaptans or thiols, amines and alcohols. A combination of chain transfer agents can also be used. Mercaptans useful in this invention are organic mercaptans which contain at least one—SH or thiol group and which are classified as aliphatic, cycloaliphatic, or aromatic mercaptans. The mercaptans can contain other substituents in addition to hydrocarbon groups, such substituents including carboxylic acid groups, hydroxyl groups, ether groups, ester groups, sulfide groups, amine groups and amide groups. Suitable mercaptans are, for example, methyl mercaptan, ethyl mercaptan, butyl mercaptan, mercaptoethanol, mercaptopropanol, mercaptobutanol, mercaptoacetic acid, mercaptopropionic acid, thiomalic acid, benzyl mercaptan, phenyl mercaptan, cyclohexyl mercaptan, 1-thioglycerol, 2.2'-dimercaptodiethyl ether, 2,2'-dimercaptodipropyl ether, 2,2'-dimercaptodiisopropyl ether, 3,3'-dimercaptodipropyl ether, 2,2'-dimercaptodiethyl sulfide, 3,3'-dimercaptodipropyl sulfide, bis(beta-mercaptoethoxy) methane, bis(beta-mercaptoethylthio)methane ethanedithio-1,2, propanedithiol-1,2, butanedithiol-1,4, 3,4-dimercaptobutanol-1, trimethylolethane tri(3-mercaptopropionate), pentaerythritol tetra(3-mercapto-propionate), trimethylolpropane trithioglycolate, pentaerythritol tetrathioglycolate, octanethiol, decanethiol, dodecanethiol, and octadecylthiol. Preferred mercaptan chain transfer agents include 3-mercaptopropionic acid and dodecanethiol.

Suitable amines which are useful as chain transfer agents are, for example, methylamine, ethylamine, isopropylamine, n-butylamine, n-propylamine, iso-butylamine, t-butylamine, pentylamine, hexylamine, benzylamine, octylamine, decylamine, dodecylamine, and octadecylamine. A preferred amine chain transfer agent is isopropyl amine and docylamine.

Suitable alcohols which are useful as chain transfer agents are, for example, methanol, ethanol, isopropanol, n-butanol, n-propanol, iso-butanol, t-butanol, pentanol, hexanol, benzyl alcohol, octanol, decanol, dodecanol, and octadecanol. A preferred alcohol chain transfer agent is isopropanol and dodecanol.

The hydrophobically modified polymers are prepared by processes known in the art such as disclosed in U.S. Pat. No. 5,147,576. Preferably, the hydrophobically modified polymers are prepared using conventional aqueous polymerization procedures, but employing a process wherein the polymerization is carried out in the presence of a suitable cosolvent and wherein the ratio of water to cosolvent is carefully monitored so as to maintain the ratio of water to cosolvent to keep the polymer, as it forms, in a sufficiently mobile condition and to prevent unwanted homopolymerization of the hydrophobic monomer and subsequent undesired precipitation thereof.

In one embodiment, the hydrophobically modified polymer has Structure (I):

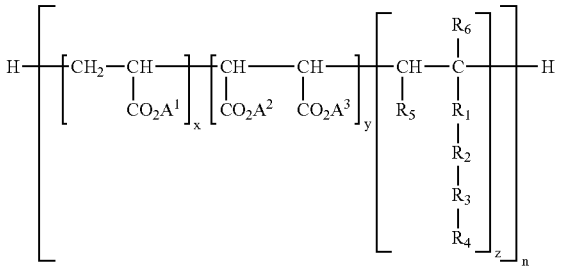

wherein z is 1; (x+y): z is from 0.1:1 to 1,000:1, preferably from 1:1 to 250:1; in which the monomer units may be in random order; y is from 0 to a maximum equal to the value of x; and n is at least 1; $R_1$ is selected from the group consisting of —CO—O—, —O—, —O—CO—, —$CH_2$—, —CO—NH—, —$CH_2$—$CH_2$—O—, and —$CH_2$—O—CO—, or is absent; $R_2$ is from 1 to 50 independently selected alkyleneoxy groups, preferably ethylene oxide or propylene oxide groups, or is absent, provided that when $R_3$ is absent and $R_4$ is H or contains no more than 4 carbon atoms, then $R_2$ is an alkyleneoxy group with at least 3 carbon atoms; $R_3$ is a phenylene linkage, or is absent; $R_4$ is selected from the group consisting of H, $C_1$–$C_{24}$ alkyl, $C_1$–$C_{24}$ alkyl sulfonate, and $C_2$–$C_{24}$ alkenyl group, provided that a) when $R_1$ is —O—CO— or —CO—O— or —CO—NH—, $R_2$ and $R_3$ are absent and $R_4$ has at least 5 carbon atoms; b) when $R_2$ is absent, $R_4$ is not H and when $R_3$ is absent, then $R_4$ has at least 5 carbon atoms; $R_5$ is H or —$COOA^4$; $R_6$ is H or a $C_1$–$C_{24}$ alkyl; and $A^1$, $A^2$, $A^3$, and $A^4$ are independently selected from the group consisting of H, alkali metals, alkaline earth metals, ammonium bases, amine bases, $C_1$–$C_4$ alkyl, and $(C_2H_4O)_t$ H, wherein t is from 1–50.

In one embodiment, the hydrophobically modified polymer has Structure (II):

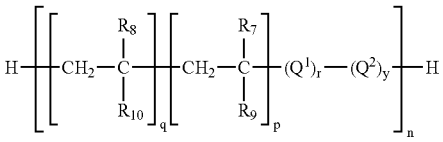

wherein $Q^2$ has the Structure (IIa):

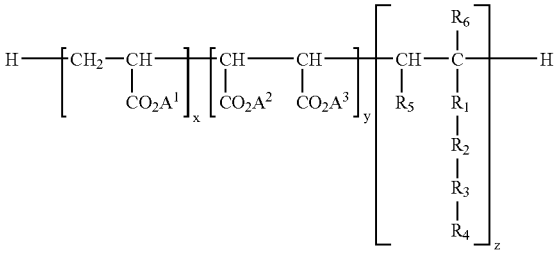

wherein $Q^1$ is a multifunctional monomer, allowing the branching of the polymer, wherein the monomers of the polymer may be connected to $Q^1$ in any direction or order, therewith possibly resulting in a branched polymer, preferably $Q^1$ is selected from trimethyl propane triacrylate (TMPTA), methylene bisacrylamide or divinyl glycol; r is 1; and (x+y+p+q+r):z is from 0.1:1 to 1,000:1, preferably from 1:1 to 250:1; in which the monomer units may be in random order; and preferably either p and q are zero, or r is zero; $R_7$ and $R_8$ are independently —$CH_3$ or —H; $R_9$ and $R_{10}$ are independently substituent groups selected from the group consisting of amino, amine, amide, sulfonate, sulfate, phosphonate, phosphate, hydroxy, carboxyl and oxide groups, preferably —$SO_3Na$, —CO—O—$C_2H_4$—$OSO_3Na$, —CO—O—NH—$C(CH_3)_2$—$SO_3Na$, —CO—$NH_2$, —O—CO—$CH_3$, and —OH.

In one embodiment, the hydrophobically modified polymer has Structure (III):

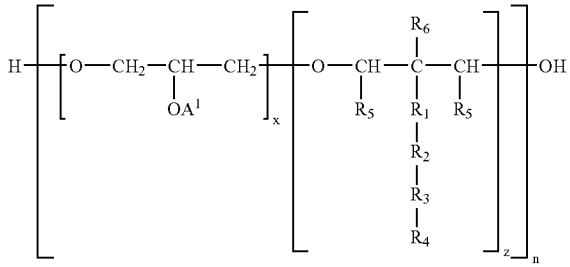

wherein z=1; x:z is from 0.1:1 to 1,000:1, preferably from 1:1 to 250:1; n is 1; $A^1$ may be a branching point wherein other molecules of Structure (III) are attached.

Examples of molecules having Structure (III) are hydrophobically modified polyglycerol ethers or hydrophobically modified condensation polymers of polyglycerol and citric acid anhydride.

In one embodiment, the hydrophobically modified polymer has Structure (IV):

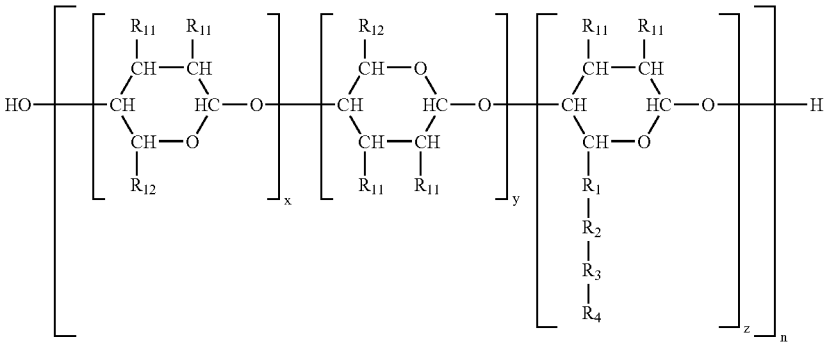

wherein (x+y):z is from 0.1:1 to 1,000:1, preferably from 1:1 to 250:1; wherein the monomer units may be in random order; $R_{11}$ is selected from the group consisting of —OH, —NH—CO—$CH_3$, —$SO_3A^1$ and —$OSO_3A^1$; $R_{12}$ is selected from the group consisting of —OH, —$CH_2OH$, —$CH_2OSO_3A^1$, $COOA^1$, and —$CH_2$—$OCH_3$.

Examples of molecules having Structure (IV) are hydrophobically modified polydextran, -dextran sulfonates, -dextran sulfates and lipoheteropolysaccharides.

In one embodiment, the hydrophobically modified polymer has Structure (V):

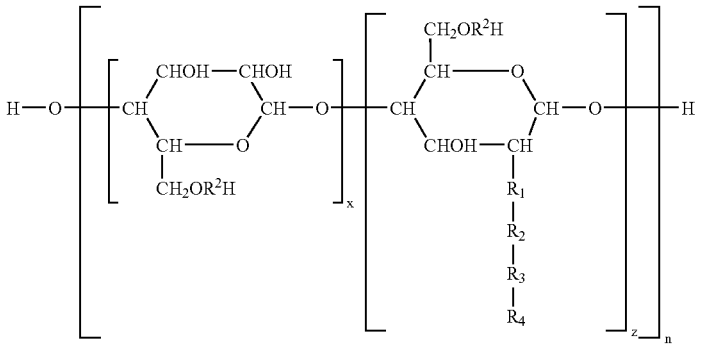

wherein z, n and $R_1$–$R_6$ are as defined above for Structure (I); and x is as defined for Structure (III).

In one embodiment, the hydrophobically modified polymers are hydrophobically modified condensation polymers of -hydroxy acids. Examples of suitable polymer backbones are polytartronate, polycitrate, polyglyconate, and mixtures thereof. In another embodiment, the hydrophobically modified polymers are hydrophobically modified polyacetals.

It is within the scope of the invention that a sample of hydrophobically modified polymers may contain full salt polymers ($A^1$–$A^4$ all other than hydrogen), full acid polymers ($A^1$–$A^4$ all hydrogen) and part-salt polymers (one or more of $A^1$–$A^4$ hydrogen and one or more other than hydrogen).

The salts of the hydrophobically modified polymers may be formed with any organic or inorganic cation defined for $A^1$–$A^4$ and which is capable of forming a water-soluble salt with a low molecular weight carboxylic acid. Preferred are the alkali metal salts, especially of sodium or potassium.

Preferred hydrophobically modified polymers include styrene (meth) acrylates and butadiene/maleic acid or maleic anhydride copolymers.

Anionic hydrophobically modified polymers are useful in the invention. Anionic hydrophobically modified polymers would include copolymers having a hydrophobe an containing amide-functional monomer with the amide functionality on the polymer backbone, in side chains, or a combination thereof. Amide monomers useful in the present invention are those not having an amine linkage in the side chain. While any polymerizable amide-functional monomer may be used, substituted amides are preferred. Substituted amines are known to push the electron balance toward the amide nitrogen, making it slightly more basic. Mono- and di-substituted amides, and especially mono-alkyl amide, mono-alkyl acrylamide, N,N, dialkyl acrylamide, and N,N, dialkyl amide are particularly preferred. Preferred amide monomers are N,N dimethylacrylamide, N,N diethylacrylamide, N-isopropylacrylamide and acryloyl morpholin. A mixture of amide monomers may be used. The amide monomer(s) make up at least 1 mole percent of the polymer, preferably at least 5 mole percent, more preferably at least 10 mole percent, and most preferably at least 25 mole percent. Amide monomer levels of greater than 40 mole percent, greater than 50 mole percent and even greater than 75 mole percent may be advantageous in some circumstances, depending on the intended end-use.

Copolymers of amino acids such as a copolymer of aspartic acid and sodium aspartate, as disclosed in U.S. Pat. No. 5,981,691 are also useful. These polymers contain an amide functionality in the backbone and are available from Folia as Reactin AS 11. Furthermore, these copolymers have an imide functionality. This imide functionality can be reacted with an amine reagent such as diethanol amine, etc to form a polymer with amide side chains.

Other non-ionic hydrophobically modified copolymer would include copolymers containing a hydrophobe an a monomer such as, but not limited to, acrylamide, vinyl pyrolidone, acryloyl morpholine, and vinyl imidazoline.

Cationic hydrophobically modified polymers include those containing a cationic monomer, such as an amine. Amine functional monomers useful in the invention include mono-, di-, tri-, and multi-amines. Examples of useful amine monomers include, but are not limited to N,N dialkylaminoalkyl(meth)acrylate, N,N dialkylaminoalkylacrylate, dialkylaminoalkyl(meth)acrylamide and N,N dialkylaminoalkylacrylamide, where the alkyl groups are independently $C_{1-18}$. Aromatic amine containing monomers such as vinyl pyridine may also be used. One skilled in the art will also be able to incorporate an amine functionality by reaction with a polymerizable anhydride (e.g. maleic anhydride), epoxide (e.g. glycidyl methacrylate), trans-esterification or condensation esterification or amidation. Furthermore, monomers such as vinyl formamide, vinyl acetamide, and the like which generate amine moieties on hydrolysis may also be used. Preferably the hydrophilic acid-neutralizable monomer is N,N-dimethylaminoethyl methacrylate, N,N-dimethylaminopropyl methacrylamide, or a mixture thereof. The amine does not include quaternary amines. It has been found that quaternary amines produce unsatisfactory redeposition properties. The copolymer contains from 25 to 75 mole percent of the amine-functional monomer, preferably from 25 to 70 mole percent, and most preferably from 25 to 60 mole percent, based on the total moles of monomer.

The hydrophobically modified polymer complexes heavy metal ions in the manufacturing or treating of textiles. For example, the hydrophobically modified polymers help stabilize hydrogen peroxide in the bleaching process, reduce scale and prevent deposition of heavy metal ions such as iron, calcium and magnesium during the scouring, desizing, mercerising, and bleaching processes. In addition, the hydrophobically modified polymers prevent redeposition of particulate soils onto the textiles.

The amount of hydrophobic moieties depends on the size of the hydrophobic group. If the hydrophobic group is relatively small, such as styrene, the hydrophobic moiety may be present at up to 90 mole percent. If the hydrophobic group is large, such as a $C_{18}$ methacrylate, then lesser amount of hydrophobic moiety is required. Generally a hydrophobically modified polymer containing 0.5 to 25 mole percent of the hydrophobic monomer is used.

Hydrotropes are compounds known to be effective in altering the phase relationships in isotropic liquid detergents. Hydrotropes useful in the present invention include, but are not limited to, alkali metal salts of alkyl, aryl sulfonates such as sodium xylene sulfonate, cumene sulfonate; and alkyl aryl disulfonates such as the DOWFAX family of hydrotropes by Dow Chemical.

In one embodiment, the hydrotrope is a hydroxyalkyl urea or hydroxyalkyl amide compound. The hydroxyalkyl urea useful in the present invention is one containing one urea functionality and at least one hydroxyl functionality. The term urea, as used herein, refers to a N—CO—N moiety in which the other two bonds on each nitrogen atom form additional attachments, as for example those found in the illustrations and examples herein. The urea and hydroxyl functionalities may be separated from each other in the compound by one carbon atom. Preferably they are separated by at least two carbon atoms. The hydroxy amide useful in the invention is one containing at least one amide functionality and at least one hydroxyl functionality.

Preferred hydroxyalkyl urea compounds are derived from urea, and comprise only a single urea group, at least one hydroxyl group, and at least two carbon atoms disposed between the urea group and each of the hydroxyl groups. The two carbons disposed between the hydroxyl and urea groups may be in linear, branched or substituted configuration. The hydroxyalkyl urea compound is represented by structure (I) as follows:

(I)

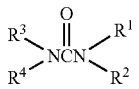

wherein

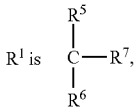

$R^2$ is H or $R^5$, $R^3$ is H or $R^5$, and $R^4$ is H, $R^1$, or $R^5$, wherein $R^5$ is H, $CH_2OH$, $\overset{R^8}{\underset{}{C}}H\overset{R^9}{C}H\overset{}{O}H$, $\overset{R^8}{C}H\overset{R^9}{C}H\overset{R^{10}}{C}H\overset{}{O}H$ or $C_1$–$C_4$ alkyl, $R^6$ is H, $CH_2OH$, $\overset{R^8}{\underset{}{C}}H\overset{R^9}{C}H\overset{}{O}H$, $\overset{R^8}{C}H\overset{R^9}{C}H\overset{R^{10}}{C}H\overset{}{O}H$ or $C_1$–$C_4$ alkyl, and $R^7$ is H, $CH_2OH$, $\overset{R^8}{\underset{}{C}}H\overset{R^9}{C}H\overset{}{O}H$, $\overset{R^8}{C}H\overset{R^9}{C}H\overset{R^{10}}{C}H\overset{}{O}H$ or $C_1$–$C_4$ alkyl, wherein $R^8$ is H, methyl or ethyl, $R^9$ is H, methyl or ethyl, and $R^{10}$ is H, methyl or ethyl.

Preferred hyroxy urea compounds are N-2-hydroxyethyl urea, N,N-bis(2-hydroxyethyl)urea, tetrakis(2-hydroxyethyl)urea, tris(2-hydroxyethyl)urea, N,N'-bis(2-hydroxyethyl)urea, N,N'-bis(3-hydroxypropyl)urea, N,N'-bis(4-hydroxybutyl)urea, N-methyl-D-glucourea, and 2-urea-2-ethyl-1,3-propanediol. Most preferably, the hydroxy urea compound is N,N'-bis(2-hydroxyethyl)urea. Combinations of hydroxyalkyl urea compounds can also be used in the method of the invention.

Other amphiphilic compounds, may also be effective in combination with the surfactant to increase processing of the concentrated surfactant. Preferably the amphiphilic compound is one that has use in the final end-product, and would be added to the final product at a level equal or greater than that needed to be effective in the concentrated surfactant.

Surfactants useful in the present invention include cationic, anionic, non-ionic, and amphoteric surfactants. Anionic surfactants include, for example, from $C_8$ to $C_{20}$ alkylbenzenesulfonates, from $C_8$ to $C_{20}$ alkanesulfonates, from $C_8$ to $C_{20}$ alkylsulfates, from $C_8$ to $C_{20}$ alkylsulfosuccinates or from $C_8$ to $C_{20}$ sulfated ethoxylated alkanols.

Cationic surfactants include, for example, dieicosyldimethyl ammonium chloride; didocosyldimethyl ammonium chloride; dioctadecyldimethyl ammonium chloride; dioctadecyldimethyl ammonium methosulphate; ditetradecyldimethyl ammonium chloride and naturally occurring mixtures of above fatty groups, e.g. di(hydrogenated tallow) dimethyl ammonium chloride; di(hydrogenated tallow) dimethyl ammonium methosulphate; ditallow dimethyl ammonium chloride; and dioleyldimethyl ammonium chloride. Di(hydrogenated tallow) dimethyl ammonium chloride or dioctadecyl dimethyl ammonium chloride are preferred cationic surfactants.

Cationic surfactants also include imidazolinium compounds, for example, 1-methyl-1-(tallowylamido-) ethyl-2-tallowyl-4,5-dihydroimidazolinium methosulphate and 1-methyl-1-(palmitoylamido)ethyl-2-octadecyl-4,5-dihydro-imidazolinium methosulphate. Other useful imidazolinium materials are 2-heptadecyl-1-methyl-1 (2-stearoylamido)-ethyl-imidazolinium methosulphate and 2-lauryllhydroxyethyl-1-oleyl-imidazolinium chloride.

Nonionic surfactants include, for example, from $C_6$ to $C_{12}$ alkylphenol ethoxylates, from $C_8$ to $C_{20}$ alkanol alkoxylates, and block copolymers of ethylene oxide and propylene oxide. Optionally, the end groups of polyalkylene oxides can be blocked, whereby the free OH groups of the polyalkylene oxides can be etherified, esterified, acetalized and/or aminated. Another modification consists of reacting the free OH groups of the polyalkylene oxides with isocyanates. The nonionic surfactants also include $C_4$ to $C_{18}$ alkyl glucosides as well as the alkoxylated products obtainable therefrom by alkoxylation, particularly those obtainable by reaction of alkyl glucosides with ethylene oxide. Amphoteric surfactants contain both acidic and basic hydrophilic groups. Amphoteric surfactants are preferably derivatives of secondary and tertiary amines, derivatives of quaternary ammonium, quaternary phosphonium or tertiary sulfonium compounds. The cationic atom in the quaternary compound can be part of a heterocyclic ring. The amphoteric surfactant preferably contains at least one aliphatic group, containing about 3 to about 18 carbon atoms. At least one aliphatic group preferably contains an anionic water-solubilizing group such as a carboxy, sulfonate, or phosphono.

The level of hydrophobicity needed in the copolymer or hydrotrope is dependent on the HLB of the surfactants. The higher the HLB, the more hydrophobic the polymer or hydrotrope needs to be to be effective.

The type of copolymer/hydrotrope useful in the invention is related to the type of surfactant with which it will be combined. For example, hydrophobically modified amine polymers, and other cationic polymers or hydrotropes will effect the physical properties of cationic surfactants. Anionic surfactants may be effected by polymers/hydrotropes having a negatively charged hydrophobic portion (anionic polymers). Both anionic and cationic copolymers/hydrotropes may be useful with non-ionic surfactants. Non-ionic polymers may be useful with anionic, cationic and non-ionic surfactants.

The polymer or hydrotrope may be combined with the surfactant by any means. The combination may include with the surfactant either a hydrotrope, a hydrophobically modified copolymer, or a combination thereof. Since the pure surfactant generally leaves its manufacturing process at an elevated temperature, polymer/hydrotrope could be added to the hot surfactant. The preferred method is to add the aqueous polymer or hydrotrope solution to the molten surfactant. However, the polymer/hydrotrope is in a dry form, and could be added as a dry solid, or could be melted prior to adding to the surfactant. The hydrophobically modified polymer or hydrotrope is present in the concentrated surfactant composition at from 0.1 to 10 weight percent, based on the weight of the surfactant, preferably from 0.5 to 5 weight percent, and most preferably from 1 to 3 weight percent based on the weight of the surfactant.

The surfactant compositions of the present invention are concentrated and contain primarily only surfactant and hydrophobically modified polymer and/or hydrotrope. The surfactant could be a blend of more than one surfactant. The surfactant composition could be an anhydrous system, or could contain up to 49.9 percent by weight of water. More preferably the concentrated surfactant composition contains water at less than 40 percent by weight, preferably less than 35 percent by weight, even more preferably less than 30 percent by weight, more preferably less than 25 percent by weight, more preferably less than 20 percent by weight, more preferably less than 15 percent by weight, even more preferably less than 10 percent by weight, and most preferably less than 5 percent by weight.

While not being bound by any particular theory, it is believed that the polymer changes the phase relationship of the surfactant micelle. Polymer becomes part of the micelle, and disrupts the packing of the surfactant molecules. This changes the physical properties of the surfactant micelle since there is a lower attraction between the surfactant molecules in the micelle. The lower attraction lowers the melting point of the surfactant and provides faster dissolution. The critical micelle concentration (CMC) of the surfactant in solution can be altered by the inclusion of the polymer. This may lead to a boost in detergency properties of the surfactant.

One advantage is that when one dissolves surfactants from the 100 percent active material they go through different phase transitions. Some of these phases are gels which are hard to overcome. The use of the copolymers or hydrotropes in combination with the concentrated surfactants eliminates the gel phase and makes processing very easy. These polymers/hydrotropes also lower the melting point and therefore you save time and money especially in the winter time.

The net effect is that the surfactants are easier to handle, and the processing is easier and faster, enabling the soaper to save costs. Many surfactants are sold in molten form, which requires heating the surfactant during transportation and storage. The lower melting point caused by the addition of a hydrophobically modified polymer to the surfactant leads to lower energy requirements and faster processing.

The surfactant composition may be used in the formulation of detergents and hard surface cleaners. The detergents and cleaners have many uses, including in shampoo, personal care products, metal cleaners, laundry and dishwash detergents, and floor cleaners. In formulations such as floor cleaners, where it is desirable to use lower amounts of surfactant for less streaking and less residual, the lower CMC allows for good performance with less surfactant, saving costs.

The following examples are presented to further illustrate and explain the present invention and should not be taken as limiting in any regard.

EXAMPLE 1

Preparation of Hydrophobically Modified Polymer Containing 33.3 Mole Percent Acrylic Acid and 66.7 Mole Percent Styrene.

An initial charge of 140 g of deionized water and 240 g of isopropyl alcohol was added to a 1 liter glass reactor fitted with a lid having inlet ports for an agitator, water cooled condenser and for the addition of monomer and initiator solutions. The reactor contents were heated to reflux (approximately 86° C.). At reflux, continuous additions of 103 g of acrylic acid, 297 g of styrene and 1 g of dodecylmercaptan (DDM), were added to the reactor concurrently with stirring over a period of 3 hours. During the same time period and for 30 additional minutes, the following initiator solutions were added to the reactor:

Initiator Solution #1

| | |
|---|---|
| t-butyl hydroperoxide | 40 g |
| Isopropyl alcohol | 20 g |
| Deionized water | 20 g |

Initiator Solution #2

| | |
|---|---|
| sodium formaldehyde sulphoxylate | 16 g |
| Deionized water | 80 g |

At the end of the initiator addition, a 47 percent aqueous sodium hydroxide solution (100 g) was added to yield a polymer solution having a final pH of approximately 7 to 8. The reaction temperature was maintained at reflux for a further 1 hour to eliminate any unreacted monomer.

After the 1 hour hold the alcohol cosolvent was removed from the polymer solution by azeotropic distillation under vacuum. During the distillation, deionized water was added to the polymer solution to maintain a reasonable polymer viscosity. The aqueous solution of the hydrophobically modified polymer was cooled to less than 30° C.

EXAMPLE 2

Preparation of Hydrophobically Modified Polymer Containing 60 Mole Percent Acrylic Acid and 40 Mole Percent Styrene.

An initial charge of 86.4 g of deionized water, 79.2 g of isopropyl alcohol, and 0.042 grams of ferrous ammonium sulfate were added to a 1 liter glass reactor. The reactor contents were heated to reflux (approximately 84° C.).

At reflux, continuous additions of 64.5 g of acrylic acid, 62.1 g of styrene, 0.1 g of dodecylmercaptan, were added over a period of 3.5 hours. The initiator and chain transfer solutions were added at the same time as the above described monomer solution over a period of 4 hours and 3.25 hours, respectively.

Initiator Solution

| | |
|---|---|
| Sodium persulfate | 5.72 g |
| Water | 14.0 g |
| Hydrogen peroxide 35% | 16.7 g |

Chain Transfer Solution

| | |
|---|---|
| 3-mercapto propionic acid, 99.5% | 4.9 g |
| water | 21.8 g |

After adding the initiator and chain transfer solutions, the reaction temperature was maintained at about 88° C. for one hour. The alcohol cosolvent was removed from the polymer solution by azeotropic distillation under vacuum. During the distillation, a mixture of 144 g of deionized water and 64.1 g of a 50 percent sodium hydroxide solution was added to the polymer solution. A small amount of ANTIFOAM 1400 (0.045 g) (defoamer from Dow Chemical) was added to suppress any foam generated during distillation. Approximately, 190 g of a mixture of water and isopropyl alcohol were distilled off. After distillation was completed, 25 g of water was added to the reaction mixture which was cooled to obtain a yellowish amber solution.

EXAMPLE 3

Preparation of Hydrophobically Modified Polymer Containing 96.1 Mole Percent Acrylic Acid and 3.9 Mole Percent Laurylmethacrylate.

An initial charge of 190 g of deionized water and 97.1 g of isopropyl alcohol were added to a 1 liter glass reactor. The reactor contents were heated to reflux (approximately 82° C.–84° C.). At reflux continuous additions of 105 g of acrylic acid, and 15.0 g of laurylmethacrylate were added to the reactor concurrently over a 3 hour period of time with stirring. Concurrently, an initiator solution containing 15.9 g of sodium persulfate and 24.0 μg of water was added over a period of 4 hours.

The reaction temperature was maintained at 82° C.–85° C. for an additional hour. The alcohol cosolvent was removed from the polymer solution by azeotropic distillation under vacuum. During the half way point of the distillation (when approximately 100 g of distillate is produced), 48 g of hot water was added to the polymer solution to maintain a reasonable polymer viscosity. A small amount of ANTIFOAM 1400 (0.045 g) was added to suppress any foam that may be generated during distillation. Approximately, 200 g of a mixture of water and isopropyl alcohol was distilled off. The distillation was stopped when the isopropyl alcohol level in the reaction product was less than 0.3 weight percent.

The reaction mixture was cooled to less than 40° C. and 45 g of water and 105.8 g of a 50% NaOH was added to the reaction mixture with cooling while maintaining a temperature of less than 40° C. to prevent hydrolysis of the laurylmethacrylate. The final product was an opaque viscous liquid.

EXAMPLE 4

Synthesis of Hydrophobically Modified Polyacrylic Acid with a $C_{12}$ Chain Transfer Agent.

524.8 g of water and 174 g of isopropyl alcohol were heated in a reactor to 85° C. A mixture of 374 g of acrylic acid and 49 g of n-dodecylmercaptan were added to the reactor over a period of three hours. After addition was completed, 65.3 g of acrylic acid was added over a period of 30 minutes to the reactor. At the same time, a solution of 17.5 g of sodium persulfate in 175 g of water was added to the reactor over a period of four hours. The temperature of the reactor was maintained at 85–95° C. for one hour, after which time, 125 g of water, 51 g of a 50% NaOH solution, and 0.07 g of ANTIFOAM 1400, available from Dow Chemical Company, were added to the reactor. The reaction mixture was distilled to remove the isopropyl alcohol. Approximately 300 g of a mixture of isopropyl alcohol and water were distilled off. The reaction mixture was cooled to room temperature and 388 g of a 50% NaOH solution was added.

EXAMPLE 5

Acrylic Acid Grafted on to a Non-ionic Surfactant.

A polymeric compound was synthesized in the following manner: Five parts of acrylic acid, 3.0 parts of a 15 mole ethylene oxide adduct of nonyl phenol nonionic surfactant commercially available from GAF Corporation under the trade name IGEPAL CO-730 and 0.7 parts of sodium hydroxide were dissolved in sufficient water to yield a 100 part aqueous solution. The solution was stirred and heated to 60° C. One part of sodium persulfate was, then, added thereto. After several minutes an exotherm was apparent with a temperature rise to 75° C. Stirring was continued for 90 minutes while the temperature was maintained at 75° C. The resulting solution was cooled and exhibited a clear, yellowish color and was slightly acidic.

EXAMPLE 6

Preparation of Copolymers Containing a Surfactant Moiety in a Hydrophilic Solvent In a reactor provided with a stirrer 750 parts by weight deionized water and 250 parts isopropanol were heated to 82.degree. C. A monomer/initiator mixture was made containing 350 parts by weight acrylic acid, 150 parts by weight of an ester of methacrylic acid and an ($C_{16-18}$) alkoxypoly (ethyleneoxy)ethanol having about twenty ethoxy units, and 8 parts by weight methacrylic acid. Five minutes before the monomer/initiator feed began, 2 parts by weight Lupersol 11 were added to the 82° C. isopropanol mixture. The monomer/initiator mixture was then metered in over 2 hours, with the reactor contents kept at 82° C. Thereafter, the reactor contents were heated at 82° C. for a further 30 minutes, then cooled, giving a copolymer dissolved in a water/isopropanol mixed solvent.

EXAMPLE 7

Synthesis of a Monomer with an Unsaturated Alkyl Hydrophobe 79 grams of a methacrylic anhydride was taken in a round bottom flask. To this, 190.7 grams of oleyl amine (70% solution obtained from Aldrich) was added with stirring at room temperature over a period of an hour. The reaction was exothermic and maintained at around 25° C. by using a cooling bath. The reaction mixture was allowed to stir for 12 hours. The final product was an opaque yellow solution.

EXAMPLE 8

Synthesis of a Copolymer Incorporating the Monomer Containing an Unsaturated Alkyl Hydrophobe.

An initial charge of 200 g of deionized water and 200 g of isopropyl alcohol were added to a 2-liter glass reactor. The reactor contents were heated to reflux (approximately 82° C.–84° C.). At reflux continuous additions of 213 g of acrylic acid, and 16.1 grams of the reaction product of the above Example were added to the reactor concurrently over a 3 hour period of time with stirring. Concurrently, an initiator solution containing 5.0 g of sodium persulfate and 75.0 g of water was added over a period of 4 hours.

The reaction temperature was maintained at 82° C.–85° C. for an additional hour. The alcohol cosolvent was removed from the polymer solution by azeotropic distillation under vacuum. A small amount of ANTIFOAM 1400 (0.045 g) was added to suppress any foam that may be generated during distillation. A solution containing 213.8 grams of 50% NaOH and 200 grams of deionized water was added during the distillation. Approximately, 300 g of a mixture of water and isopropyl alcohol was distilled off. The distillation was stopped when the isopropyl alcohol level in the reaction product was less than 0.3 weight percent. The final product was a clear amber solution.

EXAMPLE 9

Preparation of Hydrophobically Modified Polymer Containing 49 Mole Percent Acrylic Acid and 51 Mole Percent Styrene.

An initial charge of 195.2 g of deionized water, 279.1 g of isopropyl alcohol, and 0.0949 grams of ferrous ammonium sulfate were added to a 1 liter glass reactor. The reactor contents were heated to reflux (approximately 84° C.).

At reflux, continuous additions of 121.4 g of acrylic acid, 175.5 g of styrene, were added over a period of 3.5 hours. The initiator and chain transfer solutions were added at the same time as the above described monomer solution over a period of 4 hours and 3.25 hours, respectively.

Initiator Solution

| | |
|---|---|
| Sodium persulfate | 12.93 g |
| Water | 31.6 g |
| Hydrogen peroxide 35% | 37.8 g |

Chain Transfer Solution

| | |
|---|---|
| 3-mercapto propionic acid, 99.5% | 11.1 g |
| water | 49.3 g |

After adding the initiator and chain transfer solutions, the reaction temperature was maintained at about 88° C. for one hour. The alcohol cosolvent was removed from the polymer solution by azeotropic distillation under vacuum. During the distillation, a mixture of 325.6 g of deionized water and 134.8 g of a 50 percent sodium hydroxide solution was added to the polymer solution. A small amount of ANTIFOAM 1400 (0.10 g) was added to suppress any foam generated during distillation. Approximately, 375.0 g of a mixture of water and isopropyl alcohol were distilled off. After distillation was completed, 25 g of water was added to the reaction mixture which was cooled to obtain a yellowish amber solution.

EXAMPLE 10

Example 9 was Repeated but with using 60 Mmole Percent Styrene and 40 Mole Percent Acrylic Acid.

An initial charge of 195.2 g of deionized water, 279.1 g of isopropyl alcohol, and 0.0949 grams of ferrous ammonium sulfate were added to a 1 liter glass reactor. The reactor contents were heated to reflux (approximately 84° C.).

At reflux, continuous additions of 97.1 g of acrylic acid, 210.6 g of styrene, were added over a period of 3.5 hours. The initiator and chain transfer solutions were added at the same time as the above described monomer solution over a period of 4 hours and 3.25 hours, respectively.

Initiator Solution

| | |
|---|---|
| Sodium persulfate | 12.93 g |
| Water | 31.6 g |
| Hydrogen peroxide 35% | 37.8 g |

Chain Transfer Solution

| | |
|---|---|
| 3-mercapto propionic acid, 99.5% | 11.1 g |
| water | 49.3 g |

After adding the initiator and chain transfer solutions, the reaction temperature was maintained at about 88° C. for one hour. The alcohol cosolvent was removed from the polymer solution by azeotropic distillation under vacuum. During the distillation, a mixture of 325.6 g of deionized water and 107.8 g of a 50% sodium hydroxide solution was added to the polymer solution. A small amount of ANTIFOAM 1400 (0.10 g) was added to suppress any foam generated during distillation. Approximately, 375.0 g of a mixture of water and isopropyl alcohol were distilled off. After distillation was completed, 25 g of water was added to the reaction mixture which was cooled to obtain an amber solution.

EXAMPLE 11

The compatibility of styrene-acrylate copolymers in alcohol ethoxylates over a 2 month period are detailed below. The polymer solutions were added to the surfactant and stirred thoroughly. They were then observed over 2 month period. Tomadol 25-7 and Tomadol 25-9 are non-ionic surfactants from Tomah products.

TABLE 1

| Polymer | Wt % active polymer | Miscibility in Tomadol 25-7 | Miscibility in Tomadol 25-9 |
|---|---|---|---|
| Example 9 | 1 | Very slight ppt on bottom | Slight haze on the bottom |
| Example 9 | 1 | Very compatible even after 3 freeze thaw cycles | |
| Example 9 | 2 | | No ppt, very slight haze |
| Example 9 | 5 | 3 different samples, two of them had a lot of ppt, one had less, very incompatible | Very slight ppt at the bottom |

TABLE 1-continued

| Polymer | Wt % active polymer | Miscibility in Tomadol 25-7 | Miscibility in Tomadol 25-9 |
|---|---|---|---|
| Example 10 | 3 | Clear and compatible | |
| Example 10 | 5 | ppt on bottom | |

The results
(1) The polymer of Example 9 (51 mole % styrene) is more compatible in the 25-9 than 25-7
(2) The polymer of Example 9 (51 mole % styrene) can be added to the 25-9 up to 2% active polymer
(3) The polymer of Example 9 (51 mole % styrene) can be added to the 25-9 up to 1% active polymer
(4) The polymer of Example 10 (60% styrene) is more compatible than the polymer of Example 9 (51 mole % styrene) in 25-7 and can be added to 3% active polymer. Therefore, this exemplifies that the hydrophobicity of the polymer can be matched to the HLB of the surfactant to maximize compatibility.

EXAMPLE 12

Melting Point Reduction:

A sample of Tomadol 25-9 was used for testing. It is a solid at room temperature. The polymer of Example 9 (51 mole percent styrene) was added to the surfactant at several dosage levels. The samples were first cooled until they began to solidify. They were then heated and the melting point was determined as the temperature at which they became completely clear (in bold type in table below).

TABLE 2

| Sample | Temperature (° F.) | Condition |
|---|---|---|
| Tomadol 25-9 (neat) | 80 | Melting, but hazy |
| | 100.2 | Water clear |
| Tomadol 25-9 + 5% | 72 | Melting |
| polymer of Example 9 (51 mole % styrene) | 76 | All melted, but hazy due to high polymer level; pink color* |
| Tomadol 25-9 + 2% | 73 | Melting, but hazy |
| polymer of Example 9 (51 mole % styrene) | 78 | Clear, but slight pink color* |
| Tomadol 25-9 + 1% | 73 | Melting |
| polymer of Example 9 (51 mole % styrene) | 99 | Clear |

The data indicate that these polymers can be used to lower the melting point of surfactants. This makes the surfactants easier to process during formulation.

EXAMPLE 13

Additional Testing, Completed with Tomadol 25-7:

TABLE 3

| Sample | Temperature (° F.) | Condition |
|---|---|---|
| Tomadol 25-7 (neat) | 75 | melted |
| Tomadol 25-7 + 1% polymer of Example 9 (51 mole % styrene) | 70 | melted |
| Tomadol 25-7 + 1% polymer of Example 9 (51 mole % styrene) | 70 | melted |
| Tomadol 25-7 + 5% polymer of Example 10 (60% styrene) | 58 | melted |

The data indicates that the more compatible the polymer, the more polymer can be added to the surfactant and the lower the melting point will be.

EXAMPLE 14

DMAEMA/MMA 30/70 (Cationic Polymer)

To a 2 liter glass vessel equipped with; reflux condenser, stirrer, means of temperature control, 400 g water and 300 g propan-2-ol were charged then heated to a gentle reflux. A monomer mixture of dimethylaminoethyl methacrylate (106.6 g) and methyl methacrylate (160 g) was fed into the reactor over an approximate timeframe of 3 hours. Sodium persulphate solution (8.7 g in 125 g of water) was fed concurrently with the monomer over a similar time period. When feeds were complete acetic acid solution (36.6 g in 150 g water) was fed into the reactor. A propan-2-ol azeotrope was then distilled from the reactor.

EXAMPLE 15

Copolymer of N,N, dimethylacrylamide and methylmethacrylate. (non-ionic copolymer)

To a 500 ml glass vessel equipped with; reflux condenser, stirrer, means of temperature control, 200 g water and 100 grams of isopropanol was charged then heated to 85 C. A monomer mixture of N,N dimethylacrylamide available from Kohjin in Japan (70.0 g) and methylmethacrylate (30.0 g) was fed into the reactor over an approximate timeframe of 1.25 hours. Sodium persulfate solution (1.0 g in 30 g of water) was fed concurrently with the monomer over 1.5 hours. The reaction mixture was then heated for 2 hours at 85 C. The isopropanol was then distilled to produce a nearly aqueous polymer solution.

EXAMPLE 16

Hydrotrope 10 grams of a 40 percent solution of sodium xylenesulfonate was added to 90 grams of Neodol 45-7 from Shell at 60° C. The resulting solution was a homogenous solution with a lower melting point than the starting surfactant alone.

EXAMPLE 17

HAU 106.2 g diethanolamine and 61.24 g urea were charged to a 250 mL flask equipped with a condenser, thermometer, stirrer, and nitrogen purge needle. The mixture was heated at 115° C. for 5 hours. A nitrogen purge was used to remove evolving ammonia. The progress of the reaction was monitored by titration of the remaining diethanolamine with 0.1 N hydrochloric acid. A clear hydroscopic liquid was obtained which contained N,N-bis(2-hydroxyethyl)urea.

EXAMPLES 18–23

The following amines were reacted with urea according to the procedure set forth in Example 17.

| Example | Amine | Wt, g | Urea, g |
|---|---|---|---|
| 18 | Ethanolamine | 61 | 60 |
| 19 | 3-amino-1-propanol | 150 | 60 |

-continued

| Example | Amine | Wt, g | Urea, g |
|---|---|---|---|
| 20 | 2-amino-2-ethyl-1,3-propanediol (AEPD) | 119 | 30 |
| 21 | Ethanolamine | 122 | 60 |
| 22 | Diethanolamine | 210 | 60 |
| 23 | 4-aminobutanol | 12 | 4 |

EXAMPLE 24

100 grams of Neodol 45-7 (from Shell) were melted by heating to 60 C. 3.3 grams of a 60 percent solution of 2-hydroxylethyl urea from Example 18 was added with stirring. The mixture was maintained at 60° C. for 1 hour. The resultant mixture was a clear homogenous solution with a lower melting point than the starting surfactant.

EXAMPLE 25

100 grams of Tomadol 1–9 (from Tomah) were melted by heating to 60° C. 3.3 grams of a 60 percent solution of 2-hydroxylethyl urea from Example 18 was added with stirring. The mixture was maintained at 60° C. for 1 hour. The resultant mixture was a clear homogenous solution with a lower melting point than the starting surfactant.

What is claimed is:

1. A solid concentrated surfactant composition comprising:

at least 90 percent by weight of a modified surfactant blend of one or more surfactants;

from 0.1 to 10 percent by weight of a hydrophobically modified copolymer, based on the weight of the surfactant; and less than 10 percent by weight of water.

2. The concentrated surfactant composition of claim 1 comprising at least 95 percent by weight of said modified surfactant blend.

3. The concentrated surfactant composition of claim 1 wherein said modified surfactant blend comprises from 0.5 to 5 percent by weight of the hydrophobically modified copolymer, based on the weight of the surfactant.

4. The surfactant composition of claim 1 wherein said hydrophobically modified copolymer comprises a hydrophilic backbone and at least one hydrophobic moiety.

5. The surfactant composition of claim 4 wherein said hydrophilic backbone comprises monomer units selected from the group consisting of acrylic acid, methacrylic acid, maleic acid, maleic anhydride, itaconic acid, and mixtures thereof.

6. The surfactant composition of claim 4 wherein said hydrophobic moiety is one or more hydrophobic monomers selected from the group consisting of acrylate monomers, methacrylate monomers, styrene and styrene derivatives, acrylamide and alkyl acrylamide, vinyl naphthalene, and butadiene.

7. The surfactant composition of claim 1 wherein said hydrophobic moiety comprises a chain transfer agent.

8. The surfactant composition of claim 1 further comprising a hydrotrope selected from the group consisting of alkali metal salts of alkyl, aryl sulfonates; alkali metal salts of alkyl aryl disulfonates; and alkyl hydroxy urea compounds.

9. The surfactant composition of claim 1 wherein said one or more surfactants comprise one or more non-ionic surfactants.

10. The surfactant composition of claim 9 wherein said one or more non-ionic surfactants are selected from the group consisting of alcohol ethoxylates, nonylphenol ethoxylates, and mixtures thereof.

11. The surfactant composition of claim 1 wherein said one or more surfactants comprise one or more anionic surfactants.

12. The surfactant composition of claim 11 wherein said one or more anionic surfactants are selected from the group consisting of linear alkyl benzene sulfonates, alcohol ether sulfates, and mixtures thereof.

13. The surfactant composition of claim 1 wherein said surfactant comprises a blend of one or more non-ionic surfactants and one or more anionic surfactants.

* * * * *